United States Patent [19]

DiToro

[11] 4,384,286

[45] May 17, 1983

[54] HIGH SPEED GRAPHICS

[75] Inventor: Michael J. DiToro, Massapequa, N.Y.

[73] Assignee: General Signal Corp., Stamford, Conn.

[21] Appl. No.: 182,887

[22] Filed: Aug. 29, 1980

[51] Int. Cl.[3] ..... G09G 1/14

[52] U.S. Cl. ..... 340/727; 364/521; 364/742; 340/734; 340/803; 340/743

[58] Field of Search ..... 340/727, 734, 731, 728, 340/803, 804, 743; 364/521, 742, 747

[56] References Cited

U.S. PATENT DOCUMENTS

| | | | |
|---|---|---|---|
| 3,231,726 | 1/1966 | Williamson | 364/747 |
| 3,772,677 | 11/1973 | Sommer | 340/727 |
| 3,987,284 | 10/1976 | Hogan et al. | 340/727 |
| 4,127,850 | 11/1978 | Vallins | 340/727 |
| 4,168,488 | 9/1979 | Evans | 364/521 |
| 4,225,929 | 9/1980 | Ikeda | 340/727 |
| 4,280,190 | 7/1981 | Smith | 364/747 |

*Primary Examiner*—Marshall M. Curtis

*Attorney, Agent, or Firm*—Pollock, Vande Sande and Priddy

[57] ABSTRACT

A display processor for displaying complex curves includes an initiating processor, responsive to indicia selection signals for producing signals representing at least one coordinate on said indicia, and recursive processor means responsive to said initiating processor for generating a sequence of signals, each signal in the sequence representing different coordinates of said indicia, and for also generating a corresponding sequence of signals representing rate of change of at least one parameter of said coordinates, a comparator responsive to the output of said recursive processor and to instantaneous sweep position for, at times, illuminating the display field when the instantaneous sweep position matches one of the sequence of indicia coordinates. The recursive nature of the processor limits the memory required during the course of the processing, and since the recursive processor performs only the functions of shifting and adding, the processing time expended is materially reduced over that previously required.

11 Claims, 17 Drawing Figures

INITIATING PROCESSOR

HIGH SPEED GRAPHICS

FIELD OF THE INVENTION

The present invention relates to high speed graphic displays.

BACKGROUND OF THE INVENTION

Applications for graphical displays, e.g., cathode ray tube and the like, in the last few years has witnessed explosive growth. Many of these displays are required to illustrate, simulate or display complex curves. The combination of the need for flicker-free displays coupled with the complexity in the patterns to be displayed has caused the devices used to drive the display to become more complex and costly. The only relief from this tendency has been to reduce resolutions or to employ approximations to the graphic actually desired to be displayed, so as to simplify the apparatus required to drive the display. In most instances the approximation or resolution reduction is required as a practical matter while the user still desires a high resolution, exact display. Unfortunately, however, high resolution, exact displays were often impossible to achieve because the concurrent requirements of flicker-free displays (requiring approximately 30 frames per second) coupled with the high computational load needed to determine many coordinate pairs (for example, at least 1000 per frame).

One other difficulty further multiplying the complexity has been the apparent necessity to employ unique circuits or circuit combinations for generating signals to display different graphics, i.e., a typical prior art display generator might employ a collection of circuits to display linear graphics, a different circuit or circuit combination to generate circular graphics and still further circuit combinations to generate ellipses. In some instances, some of the circuitry was employed in common, but still each different form of graphic required at least some unique circuitry. Obviously, complexity could be reduced if common circuitry could be employed to generate line, circle and ellipse (or ellipse portion) graphics.

As is well known to those skilled in the art, in many instances, complex circuits which are designed to solve specific forms of equations can also be replaced by a stored program processor with a program which simulates the operation of the circuit in random access logic rather than in fixed discrete logic. This ability of the prior art to substitute stored program processing power for discrete circuits does not result in the solution of the problems mentioned above since each of the various forms of graphic require different subroutines and therefore, generation of an entire frame may require a stored program processor to refer to a multiplicity of routines which result in a similar computational load.

The display of three-dimensional objects on a two dimensional display appears to require the ability to display circles, straight lines and ellipses. In particular, an isometric drawing of a circle, for example, is in the form of an ellipse, and therefore, many two dimensional displays of three-dimensional objects consist of straight lines and ellipses or portions of ellipses. If the object to be displayed is to be displayed as moving (e.g., rotating, translating and changing in overall size) a non-flickering display of 30 frames per second can require the sequential generation in tens of microseconds of each of the lines and/or ellipses comprising the figure. This may readily result in an uneconomical computational burden when the figures are composed of graphics which are described in polynomial form, the solution to which requires a complex operation such as multiplication, division and/or square rooting.

A typical example of a display device which can be improved in accordance with the present invention is described in U.S. Pat. No. 4,181,956 issued Jan. 1, 1980 to Schwab et al entitled "Digital Indicia Generator Employing Compressed Data" and assigned to the assignee of this application. In the Schwab et al patent, a display generator for displaying straight lines is disclosed which employs a first order approximation to an exact straight line display, when used with a polar swept display, i.e., R-$\theta$, rather than a Cartesian sweep. In order to produce a display illustrating a reasonably straight line, especially for indicia which are relatively long, the straight line desired to be displayed is broken up into segments within which the first order approximation employed is accurate within an acceptable tolerance. Since the display generator does not automatically segment the indicia sought to be displayed, this is a burden placed on the operator which would not at all be necessary if the display generator operated to produce the indicia actually sought to be displayed, i.e., a straight line, and this burden could be eliminated by a display generator operating with exact rather than approximate processes. In addition, the approximation produces a sequence of segments, each at an angle to its neighbors so that the straight line approximation is in reality a sawtooth type indicia.

It is therefore one object of the present invention to provide a display generator which is capable of generating those signals necessary for use with a display having a predetermined sweep pattern, to display lines, circles and ellipses. It is a further object of the present invention to meet the foregoing object at the same time by the use of circuits and/or routines which do not require the complex processes such as multiplication, division or square rooting. It is a further object of the invention to provide a display generator capable of displaying straight lines, circles and ellipses which can be implemented with relatively simple digital circuitry or processes requiring only essentially the digital operations of shifting and addition and eliminating, almost entirely, the more complex operations of multiplication, division and/or square rooting. It is a further object of the invention to meet the foregoing objects in a device which is capable of use with different sweep patterns, e.g., Cartesian sweeps and/or polar sweeps.

SUMMARY OF THE INVENTION

The invention meets these and other object by providing, in a display device for displaying selected indicia on a field swept in a predetermined pattern, a processor for generating a sequence of signals, each representing coordinates of said selected indicia in response to indicia selection signals, said processor comprising:

an initiating processor responsive to said indicia selection signals for producing digital signals representing a first coordinate of said selected indicia and further digital signals representing rate of change of at least one component of said first coordinate, a recursive processor responsive to said digital signals and to said further digital signals for producing a sequence of digital signals each representing different coordinates of said selected indicia, each said different coordinates spaced from adjacent coordinates by a predetermined distance, and a comparator responsive to said recursive processor and to signals indicative of instantaneous sweep position for illuminating said display field when said sweep is in a position corresponding to a coordinate of said indicia.

In accordance with the invention, the initiating processor operates on indicia selection signals. The indicia selection signals can, for example, in the case of an ellipse, comprise signals definitive of the extent of the major and minor axes of the ellipse, as well as a further signal indicative of the orientation of the ellipse with respect to sweep coordinates. The initiating processor responds to those signals and produces the digital signals representative of a first coordinate of said indicia, along with the further digital signals representative of a rate of change of at least one component of the coordinate. As is disclosed herein, the initiating processor requires a multiplication operation. However, since the initiating processor need operate only once for each different graphic symbol, the burden of this multiplication process is limited.

The recursive processor responds to the digital signals and to the further digital signals produced by the initiating processor to generate a sequence of digital signals representing other coordinates of the selected indicia. The recursive processor employs only the processes of shifting and addition which digital processes can be accomplished with time expenditure in the nanosecond range with state of the art circuitry or processors.

Thus, in response to the indicia selection signals, the inventive processor will generate a sequence of signals representing coordinates of the desired indicia with a resolution which can be selected at the time the circuitry is designed or when the processing routines are written. Increasing the resolution will require an increase in the number of operations required to be performed, but since the unit time for processing a single coordinate is in the nanosecond range, thousands of operations can be performed in times measured in microseconds, thereby allowing adequate resolution without unduly long processing time.

As thus far explained, the inventive processor generates coordinates of the selected indicia which describe the indicia as centered at the origin of a display field. As those skilled in the art are aware, the indicia to be displayed can be located anywhere within the display field by simply adding a constant, or constants, to each of the signals representing the coordinates, the constant or constants representing the translation from the origin. Inasmuch as this feature is well known to those skilled in the art, and requires a negligible additional amount of processing time, at least for raster type sweeps, it will only be briefly referred to hereinafter.

In order to illustrate the advantages of the invention, consider the solution of a problem requiring display of an ellipse, centered at the origin. Inasmuch as circles and straight lines are degenerate forms of an ellipse, it should be apparent to those skilled in the art that the same processes (i.e., circuitry and/or routines) which generate signals capable of displaying an ellipse, are also capable of generating those signals necessary to display circles and/or straight lines.

FIG. 2 illustrates an ellipse, centered at $X_0$, $Y_0$ of a field, having a major axis 2A and a minor axis 2B, and inclined at an angle $\theta$ to the coordinate system. If the value of x on the ellipse is given, then the corresponding value y(x) on the ellipse is given by the following equations:

$$y(x) = y_0 + \frac{-b \pm \sqrt{b^2 - 4ac}}{2a} \tag{1}$$

$$a = \cos^2\theta + \frac{B^2\sin^2\theta}{A^2} \tag{2}$$

$$b = (X - X_0)\left(\frac{B^2}{A^2} - 1\right)\sin 2\theta \tag{3}$$

$$c = (X - X_0)^2\left[\sin^2\theta + \frac{B^2\cos^2\theta}{A^2}\right] - B^2 \tag{4}$$

where A is half the major axis and B is half the minor axis.

To display this ellipse on a cathode ray tube (CRT), given its imputed parameters of inclination $\theta$, major and minor axes 2A and 2B, and its center displacement $X_o$ and $Y_o$, start with any X, which is the horizontal deflection of the CRT, and calculate the vertical deflection Y using Eq. 1–4. If the radical in Eq. 1 is imaginary, then the chosen X is outside the ellipse, and there exists no corresponding value of Y. When the radical is real, there are two values of Y, as is obvious from FIG. 2. A sequential scan of X for all real radicals covers the whole ellipse. Note that the determination of Y requires the functions of addition and subtraction, multiplication, division, and square rooting. For a display frame comprising many such ellipses per frame, each displayed in sequence, and the requirement of generating 30 such frames per second, the resultant computation burden becomes quite large.

However, by using a dummy (angle) variable $\phi$ equations 1–4 can be rewritten, as functions of $\phi$ as equations 5–12:

$$x(\phi) = A'' \cos\phi - B' \sin\phi \tag{5}$$

$$x'(\phi) = A'' \sin\phi - B' \cos\phi \tag{6}$$

$$y(\phi) = A' \cos\phi + B'' \sin\phi \tag{7}$$

$$y'(\phi) = -A' \sin\phi + B'' \cos\phi \tag{8}$$

where $x'(\phi)$ is the first derivative of $x(\phi)$ with respect to $\phi$, and likewise for $y'(\phi)$ and $y(\phi)$, and where $$A' = A \sin\theta \tag{9}$$

$$A'' = A \cos\theta \tag{10}$$

$$B' = B \sin\theta \tag{11}$$

$$B'' = B \cos\theta \tag{12}$$

However, merely rewriting the equations for the ellipse in the form shown as equations 5–12 does not reduce the computational burden, it merely requires a different form in that the square rooting, multiplication and division has now been reduced to multiple multiplications.

Significantly, however, we can also relate the coordinates of one point on the indicia at the dummy variable $\phi$ to its adjacent points at the dummy variable $\phi+u$ with the exact equations 13–16 as follows:

$$x(\phi+u)=x(\phi)\cos u+x'(\phi)\sin u \quad (13)$$

$$x'(\phi+u)=x'(\phi)\cos u-x(\phi)\sin u \quad (14)$$

$$y(\phi+u)=+y(\phi)\cos u+y'(\phi)\sin u \quad (15)$$

$$y'(\phi+u)=y'(\phi)\cos u-y(\phi)\sin u \quad (16)$$

where u represents an angular increment from $\phi$ to the adjacent coordinates $\phi+u$.

Significantly, in respect of equations 13–16, is the fact that given $x(\phi)$ and $y(\phi)$ along with the associated quantities $x'(\phi)$ and $y'(\phi)$, we can determine the new coordinates $x(\phi+u)$ and $y(\phi+u)$ at the new angle $\phi+u$. Note that the equations 13–16 are not approximations; they are exact. Furthermore, and also significant in connection with digital circuitry and/or digital processors, these are recurrence relationships in that given the "old" values $x(\phi)$, $y(\phi)$, $x'(\phi)$ and $y'(\phi)$, along with the incremental quantity or angle u, we can determine the "new" coordinates $x(\phi+u)$, $y(\phi+u)$ at the angle $\phi+u$. The recurrent characteristic of these equations minimizes the required storage or memory since it is only necessary to store the preceding "old" coordinates at any $\phi$ in order to generate the "new" coordinates at $\phi+u$. Note also that no higher derivatives of x and y, other than the first, are required to exactly determine the new coordinates at $\phi+u$, given the coordinates at $\phi$.

Although the value of u in equations 13–16 is unrestricted, in order to provide adequate display continuity, the augmenting parameter u is necessarily small. However, when u is small we can then, without significantly degrading the accuracy of the results, desirably employ the simplifying relation $\sin(u)=u$ and $\cos(u)=1-0.5u^2$. Furthermore, if we select u to correspond to a binary number $2^{-b}$, we can relate the new with the adjacent "old" coordinates, designated by the subscripts 2 and 1, as follows:

$$x_2=x_1-x_1(2^{-2b-1})+x'_1(2^{-b}) \quad (17)$$

$$x'_2=x'_1-x'_1(2^{-2b-1})-x_1(2^{-b}) \quad (18)$$

A relationship similar to equations 17 and 18 can be written for the relationship between the other coordinate component y. To implement this relationship in digital form one obtains $x_2$ by beginning with $x_1$, subtracting from it $x_1$ (after having shifted $x_1$ to the right by $2b+1$ bit positions), and finally, adding to the result $x'_1$ (after having shifted it to the right by b bit positions). A similar process can be used to obtain $y_2$ and $y'_2$ from $y_1$ and $y'_1$. The operations required in the solution of this relationship is merely shifting and adding, and can be accomplished in tens of nanoseconds. An ellipse, for example, with resolution requiring illumination of 1000 coordinate pairs, can be determined in tens of microseconds; this is many orders of magnitude smaller than the time required to process the same number of coordinates using relationships (1) through (4) requiring multiplication, division and square rooting.

Furthermore the computational burden, lightened in accordance with equations 17 and 18, can further be reduced by employing the relationship:

$$x\left(\phi+u+\frac{\pi}{2}\right)=x'(\phi+u) \quad (19)$$

$$y\left(\phi+u+\frac{\pi}{2}\right)=y'(\phi+u) \quad (20)$$

Employing the relationships of equations 19 and 20, coordinates covering the entire ellipse can be determined by using equations 17 and 18 over a halfspan of the ellipse, i.e., $(-\pi/2)$ to $(+\pi/2)$, and then employing equations 19 and 20 for the span $(+\pi/2)$ to $(-\pi/2)$. The foregoing calculations of $x(\phi)$ are referenced to origin $o^1$ of the center of the ellipse in FIG. 2. Restoration to the coordinates of FIG. 2 comprise merely adding the shifts $x_o$ and $y_o$ between $o^1$ and 0.

Once the coordinates, representing points on the indicia sought to be displayed, are generated, the signals can be compared with the sweep signals and the display illuminated on an equal comparison, see in this regard FIGS. 1, 3 and 12 of the referenced U.S. Pat. No. 4,181,956. In prior art display generators it was advisable to predetermine all the coordinates of the indicia to be displayed, store such results, and read out the stored information as the sweep is generated, rather than to compute each point on the indicia as the sweep is generated. It is however, a significant advantage of this invention that such function is not necessary. More particularly in conventional radar displays, in which 2048 azimuth positions are used, each with separately resolvable 2048 range positions, the sweep is displaced from one range cell to the next in about 40 nanoseconds. The present invention allows different coordinates to be determined in times of the same order of magnitude so that, if desired, different coordinates may be displayed in response to determinations made "on the fly", as the sweep is actually traced out. This eliminates the huge memory requirement and requires storage of only that information used to initially define the indicia to the recursive processor. In addition to the foregoing however, and as another aspect of the invention, use of coordinates representing indicia (such as straight lines, circles, ellipses, etc.) can be effected without displaying the indicia themselves. It can be desirable, for example, to select among certain information bearing signals based on a particular indicia. For example, a user may desire to display a portion of a waveform above a threshold, in which case the indicia could be a straight horizontal or vertical line and the information bearing signal is displayed only when it has a fixed relation (i.e. greater than) to the indicia. This is effected by comparing indicia coordinates; processed on the fly, with sweep position, and gating the display only when the desired relation exists. As another practical example, it may be desired, in connection with an airport radar capable of displaying taxiing aircraft, to display aircraft only within certain boundaries (indicia), which may be composed of straight lines, for example, corresponding to a runway or taxiway. The invention can be employed to select those information bearing signals which meet predetermined criteria relative to selected indicia, i.e. within runway boundaries. FIG. 12A shows a PPI of a radar illustrating a runway bounded by lines L1 and L2 (L1 extending between R11 and R12, and L2 extending between R21 and R22), extending in azimuth between $\phi$1 and $\phi$2. In this application the information in a video signal is contained in its timing, therefore the apparatus must determine, for a particular azimuth, whether the boundary is defined, and if so, whether the range corresponding to a particular video signal is within the boundary, at that azimuth. This is effected, by gating the recursive display generator on and off as the display sweep reaches the start and stop azimuths, respectively. A first coordinate ($\phi_1$ and $S_1=1/r_1$) is determined for each boundary, this (S) is compared with returned video, and if the desired relation exists the video is enabled, otherwise it is not. The display generator is clocked on the next azimuth clock to compute a new coordinate $\phi_2=\phi_1+\Delta$, $S_2$ and this comparison is again made. In this fashion only video signals bearing the desired relation are displayed. Accordingly, another aspect of this invention comprises a display apparatus for displaying selected information bearing signals, selected by comparison with coordinates of selected indicia, which indicia are defined by compressed indicia defining data the display apparatus comprising:

a recursive processor responsive to said indicia defining information for producing a sequence of digital signals, each representing different coordinates of said selected indicia, a clock, and two dimensional sweep means responsive to said clock for generating signals for sweeping a display field in two dimensions, gating means for gating said information bearing signals, visible signal generating means responsive to said sweep means and to said gating means for generating visible signals corresponding to information bearing signals passed by said gating means, a first comparator for comparing one of said indicia defining signals with a first coordinate of said instantaneous sweep position, second gating means for gating said recursive processor means in response to an equal comparison from said comparator, and a second comparator responsive to a signal from said recursive processor and to a signal representative of instantaneous sweep position in said other coordinate for producing an output signal when said instantaneous sweep position representing signal bears a predetermined relation to a signal from said recursive processor means, and means coupling said second comparator means to said gating means.

BRIEF DESCRIPTION OF THE DRAWINGS

In order to more fully describe the invention so as to enable those skilled in the art to make and use the same, the invention is further described in the following portions of the specification when taken in conjunction with the attached drawings in which like reference characters identify identical apparatus or functions and.

DETAILED DESCRIPTION OF PREFERRED EMBODIMENTS

Figure 1:
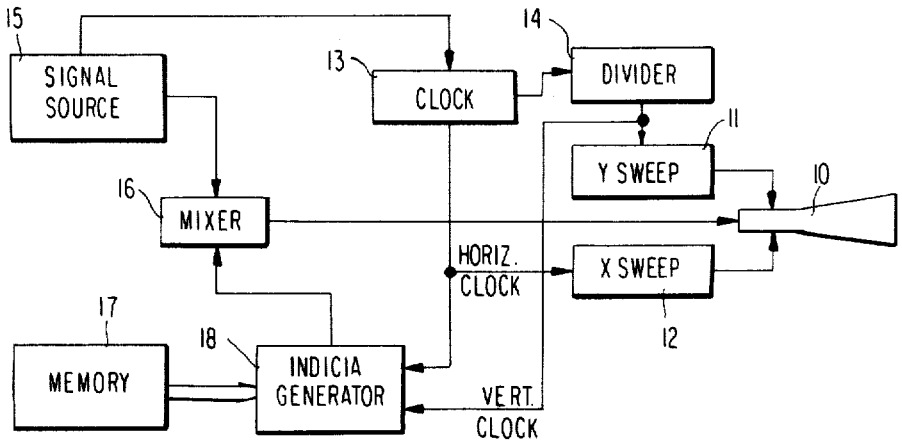
FIG. 1 is a block diagram of a display generator which can employ the inventive processor of the present invention.

As shown in FIG. 1, a display device, such as CRT 10, with a raster scan deflection system including Y sweep generator 11 and X sweep generator 12, is arranged to display selected indicia and may also display, in connection with the selected indicia, information bearing signals. More particularly, a clock 13 drives the X sweep generator 12 and the Y sweep generator 11 through a divider 14. The signal source 15 represents a source of externally generated signals which can be displayed in the display field of the display device 10 along with the selected indicia. The signal source 15 is coupled through a mixer 16 to the unblanking control for the display 10 and also provides a triggering input for the clock 13. As one example, the signal source 15 may comprise the output of a radar system. The remaining apparatus of FIG. 1 is arranged to display a selected indicia, concurrent with the display of the signals from the source 15 and employing the same deflection system. As shown in FIG. 1, these other components include a memory arrangement 17 driving an indicia generator 18. The indicia generator 18 receives, in addition to the input provided by the memory 17, horizontal and vertical clock signals as well as horizontal and vertical sweep reset signals (not illustrated) and provides a second input to the mixer 16 for display purposes. The apparatus of FIG. 1, as well as an arrangement for displaying selected indicia with a display swept in polar coordinates, is more completely described in the above-referenced U.S. Pat. No. 4,181,956 issued Jan. 1, 1980.

Figure 2:
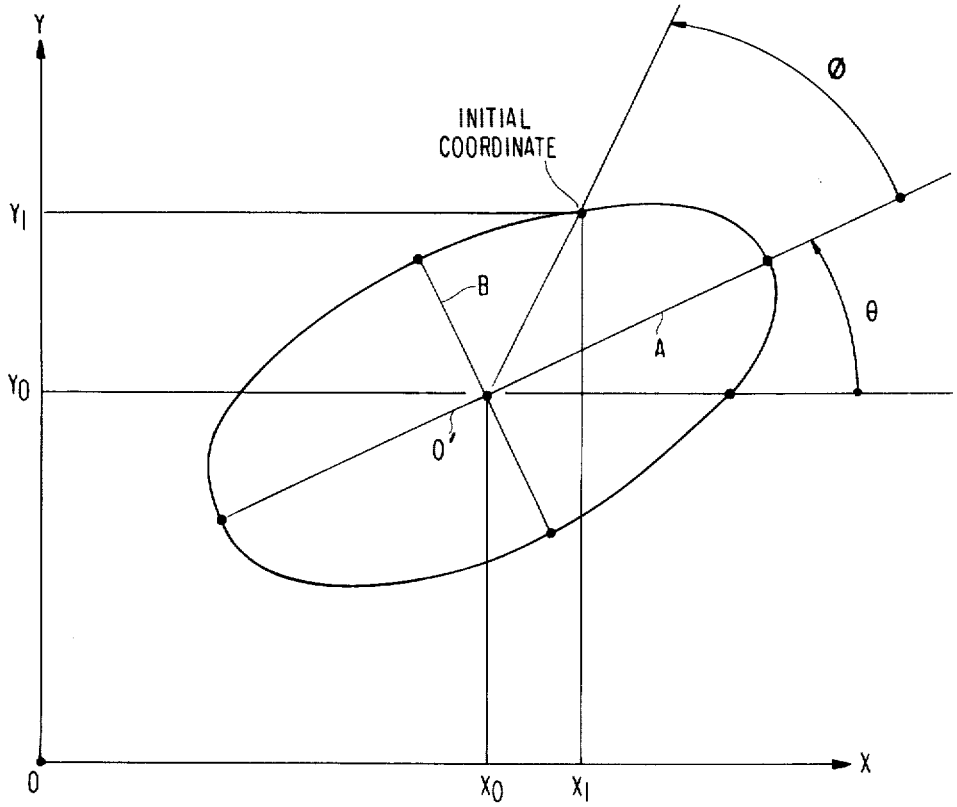
FIG. 2 illustrates the parameters of a typical ellipse in rectangular coordinates.

The present invention is more particularly related to an improved method and apparatus of generating data required for the indicia generator 18 of FIG. 1 and FIG. 3 of the referenced patent for use with raster or polar swept displays. FIG. 3A is a block diagram of one embodiment of the inventive processor including an initiating processor 30 and a recursive processor 31. As shown in FIG. 3A, initiating processor 30 responds to indicia selecting signals, i.e., those signals which identify the indicia to be displayed. Those signals comprise the parameters A,B, and $\theta$, and $\phi$, defining, respectively, the parameters as shown in FIG. 2. The initiating processor outputs signals which can be represented as four words, a first pair of words corresponding to a first coordinate of the indicia and comprising $X_1$, $Y_1$. In addition, two additional words comprising $X'_1$ and $Y'_1$, respectively, the rates of change of the indicia at the first coordinate. The recursive processor then provides a sequence of digital signals representing the indicia sought to be displayed, and defined by the initial indicia selecting signals input to the initiating processor. The sequence of signals output by the recursive processor include a sequence of X and Y signals, each pair defining a different point on the indicia, and these are coupled to comparators as is illustrated in the referred to patent for, at times, causing the mixer 16 to intensify the display to thereby illuminate a point on the display corresponding to the coordinate identified by the X and Y words. Alternatively, the output of the recursive processor may be buffered before being coupled to the comparators. As shown in FIG. 3A, and as is mentioned above, the indicia defined by the indicia selecting words may be displayed at any selected location in the display field by appropriately translating the indicia. To translate the indicia, the origin is translated by providing $X_0$ and $Y_0$ words input to adders 32 and 33, the other input of which comprises the sequence of X and Y words from the recursive processor 31. As a result, the output of the adders 32 and 33 provide a sequence of signals identifying the coordinates of the indicia, as displaced in accordance with $X_0$ and $Y_0$.

Figure 3A:
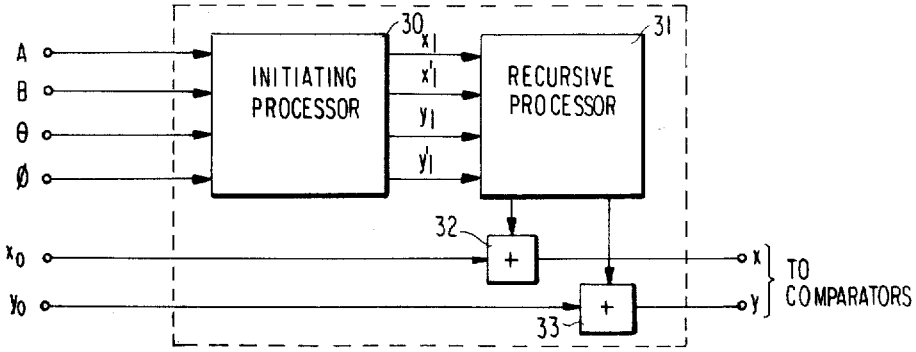
FIG. 3A is a block diagram of the inventive processor.
Figure 3B:
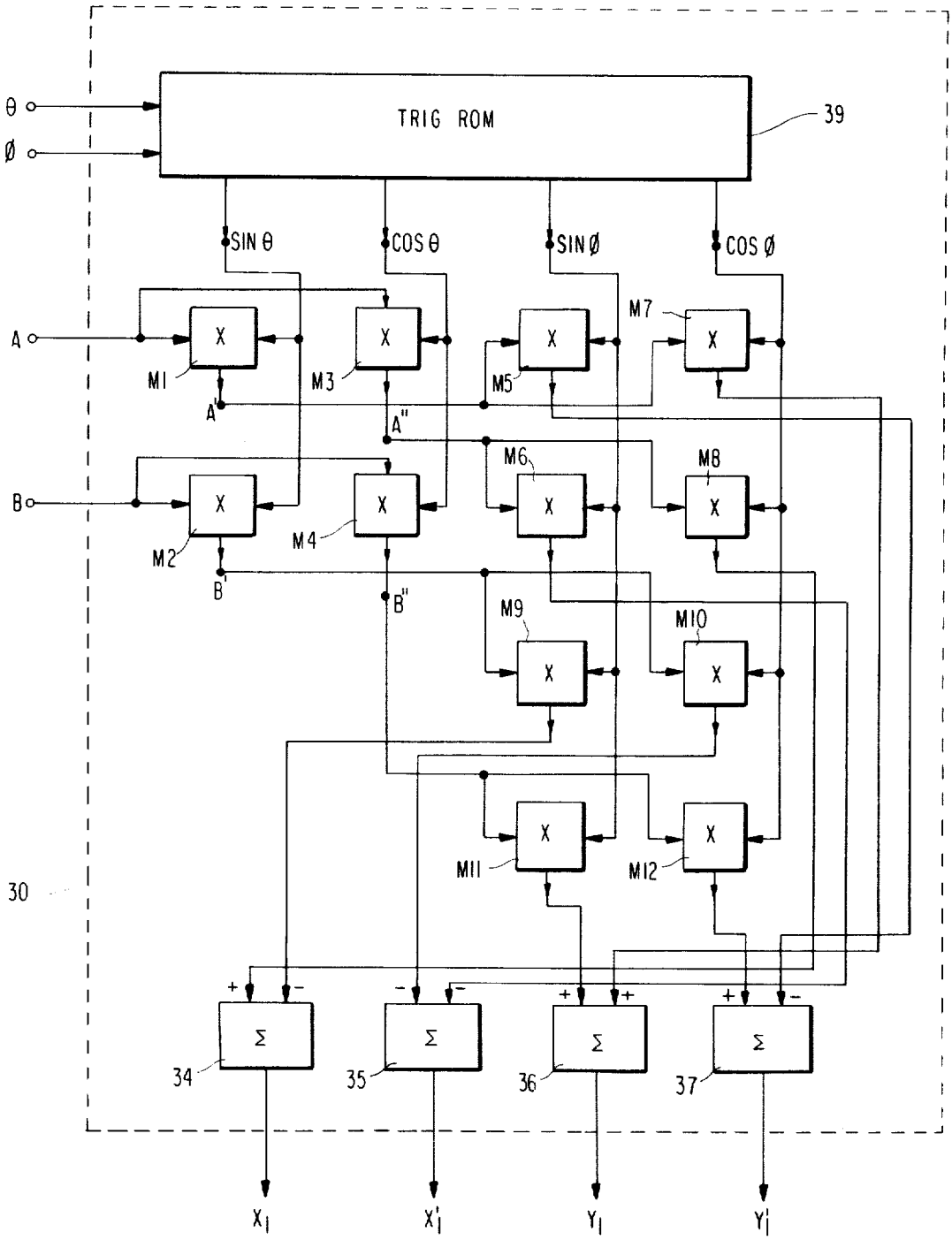
FIG. 3B is a detailed block diagram of the initiating processor of FIG. 3A.

FIG. 3B is a detailed block diagram of the initiating processor 30.

In order to implement equations 5–12 the trignomeric functions of $\theta$ and $\phi$ must be derived. As shown in FIG. 3B a trignometric ROM 39 is employed which sequentially is addressed by digital representations of $\theta$ and $\phi$ to produce the four outputs noted in the drawing. It should be apparent that ROM 39 could be replaced by any other device for deriving the desired quantities, for example the quantities could be calculated. The circuitry for applying the addressing inputs sequentially, and for buffering the outputs, comprising simple registers and gating circuitry, is omitted for clarity as such circuitry can be supplied by those skilled in the art.

Once the trig function representations are available, they and the representations of the parameters A and B are applied to a matrix of multipliers and adders, as shown in FIG. 3B. More particularly (digital) multipliers M1–M4, each with two inputs, produce the quantities A', B', A'', B''. This can be effected by gating all multipliers simultaneously when both the trig functions and parameters A and B are present. Following that operation the multipliers M5–M12, each with two inputs comprising the same trig functions and the result of the operation of M1–M4, operate to produce the eight parameters whose sum, in pairs, are $X_1$, $Y'_1$ and $X'_1$, $Y_1$'. This is effected by gating the multipliers M5–M12 simultaneously in the joint presence of the trig functions and the outputs of M1–M4. Accordingly, the eight parameters of the desired quantities are presented to the adders 34–37 with the polarity indicated. The timing circuitry to gate the various multipliers M1–M12 and buffers are, again, omitted as anyone skilled in the art could provide such apparatus.

Figure 3C:
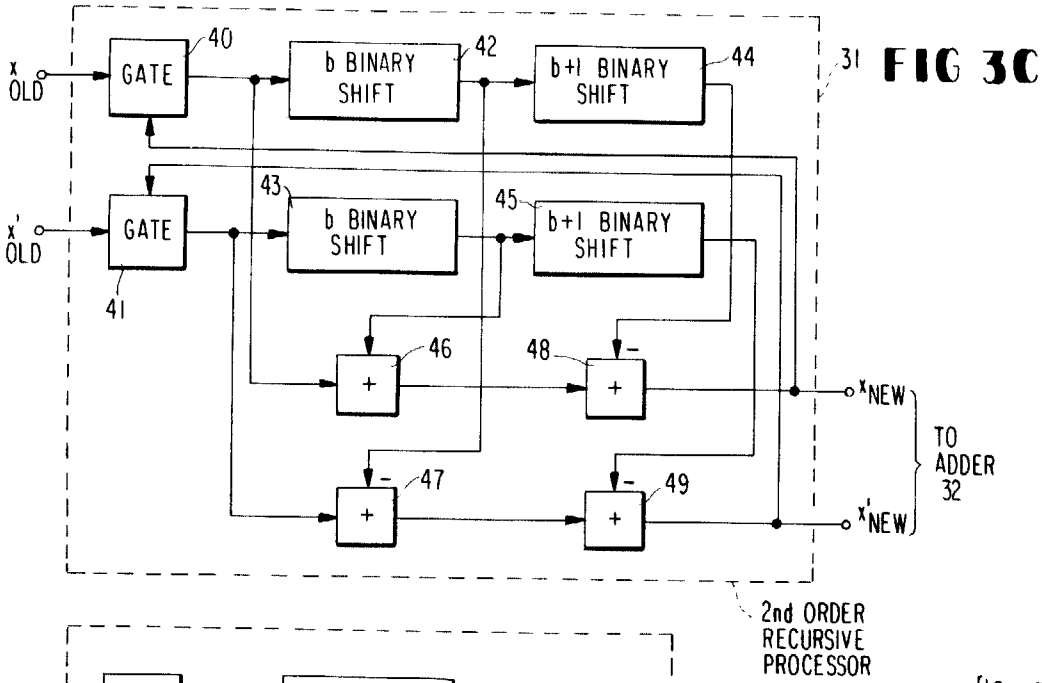
FIGS. 3C and 3D are two different embodiments of the recursive processor of FIG. 3A.
Figure 3D:
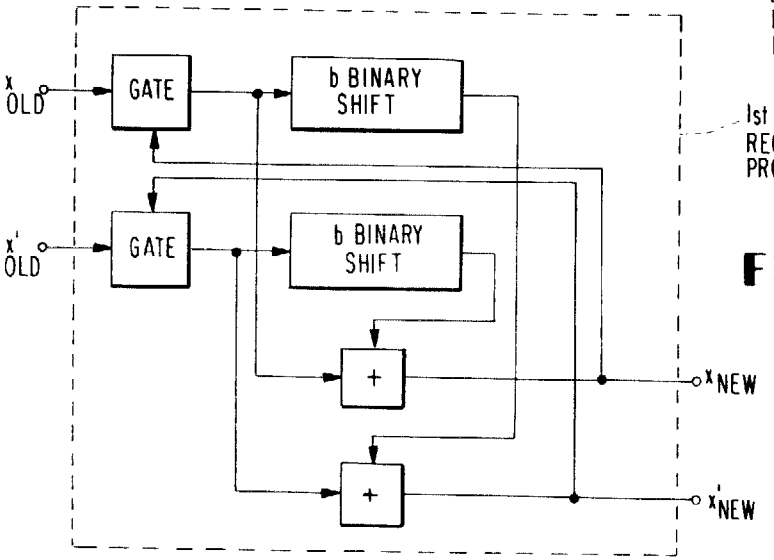

FIGS. 3C and 3D illustrate respectively two different embodiments of a recursive processor in accordance with the present invention. The processor of FIG. 3D is a first order processor which produces a close approximation to the exact ellipse; for small portions of an ellipse the output signals of the first order recursive processor shown in FIG. 3D may indeed be sufficient.

Reference is made, however, to FIG. 3C which illustrates a second order recursive processor producing signals which are very closely representative of the indicia sought to be displayed. The recursive processor of both FIGS. 3C and 3D can process signals necessary for one coordinate (i.e., X or Y), and therefore, normally two such recursive processors are required in any display. However, as those skilled in the art will understand, by appropriately adjusting timing and/or control signals, the single recursive processor of FIGS. 3C and 3D may be employed for both coordinates by suitably time sharing the same.

Referring now to FIG. 3C, it will be seen that the recursive processor comprises a plurality of gates, shifters and adders, and significantly, no multiplication, division or square rooting is performed. More particularly, a gate 40 has a pair of inputs and an output and a gate 41 also has a pair of inputs and an output. The output of gates 40 and 41 are coupled, respectively, to shifters 42 and 43, each providing for an equal b bit shift in the words presented at the input. Each of the shifters 42 and 43 has an output which is coupled, respectively, to inputs or further shifters 44 and 45. Each of the shifters 44 and 45 shift the input presented thereto by an equal amount of b+1 bits.

The output of shifters 42 and 43 is also coupled respectively to an inverting input of an adder 47 and a non-inverting input of an adder 46. The other inputs to adders 46 and 47 are derived, respectively, from the output of gates 40 and 41. The output of adders 46 and 47 are provided, respectively, as inputs to additional adders 48 and 49. Adders 48 and 49 have inverting inputs connected, respectively to the outputs of additional shifters 44 and 45. The output of adder 48 comprises a sequence of signals, each defining one coordinate of the display and thus the sequence defines a sequence of one coordinate of the indicia. The output of adder 49 comprises a sequence of signals each designating the rate of change of that coordinate and thus, the sequence of signals defines the sequential rate of change of the indicia coordinate. The outputs of adders 48 and 49 are coupled, respectively, as inputs to gates 40 and 41. The other input to gates 40 and 41 are derived from the initiating processor 30 for the corresponding coordinate and its rate of change.

Gates 40 and 41 are enabled to couple the initiating processor output to the shifting devices 42, 43 only at the beginning of the indicia generation process. Once the summing devices 48,49 produce their first output, that first output is coupled back to gates 40 and 41, and that output and succeeding outputs from the summing devices 48,49 are coupled by the gates to the shifting devices 42,43, respectively. For example, a simple monostable multivibrator, set to an astable state by the start signal from the initiating processor 30 can be used to control the gates 40, 41 to achieve the desired operation. When the monostable multivibrator times out, and switches to its rest state, gates 40 and 41 are controlled to couple the outputs of the summers to the shifting devices.

Those skilled in the art will understand how the various elements of FIG. 3C can be controlled by clocking signals, and therefore no description of such operation is provided.

While FIGS. 3C and 3D illustrate single lines coupling various devices, it should be understood that this is not meant to imply serial data transfer. More particularly, each of the digital signals referred to herein are multibit signals, and while they can be transferred from one circuit element to another in a serial fashion, a transfer can also take place in parallel fashion in a manner well known to those skilled in the art.

In operation, the circuit of FIG. 3C implements the solution of equations 17 and 18. That is, more particularly, the gate 40,41 couple coordinates, for example $X_{old}$ and $X'_{old}$ to the shifting devices 42,43. The use of subscripts old and new is, of course, relative since the recursive processor operates sequentially. An output of adder 48 is a "new" coordinate while that same signal, when fed back to gate 40, is an "old" coordinate. Each of the shifting devices provides for a b bit right shift, corresponding to a multiplication by $2^{-b}$. Thus, adder 46 sums $X_{old}$ with $X'_{old}(2^{-b})$. That sum is coupled as one input to adder 48 whose other terminal receives, from the shifting device 44, a signal representing $X_{old}2^{-2b-1}$. The latter input is inverted by the adder 48, and thus the difference produced corresponds to $X_{new}$. In a like fashion, the combination of adder 47, shifting device 42, adder 49 and shifting device 45 derive a signal representing $X'_{new}$. The signal $X_{new}$ is provided to the adder 32 and also fed back to become, on a next cycle of operation of the circuit of FIG. 3C $X_{old}$. As will be understood by those skilled in the art, the circuit of FIG. 3C may be duplicated to handle the other term for each coordinate or, on the other hand, the circuit of FIG. 3C can be time shared. Of course, time sharing the circuit of FIG. 3C requires the addition of buffers to store signals representing one of the coordinate parameters, for example, X and X', while the other coordinate parameter, Y and Y', was being operated on.

Accordingly, as explained above, the recursive processor responds to the output of the initiating processor and produces a sequence of digital signals, each signal in the sequence representing different coordinates of the selected indicia. Since the displacement between $X_n$ and $X_{n+1}$ is related to u, the augmenting parameter, each coordinate is spaced from adjacent coordinates by a predetermined (angular) distance.

In a similar fashion, the circuit of FIG. 3D implements a first order equation which provides more approximate signals representing the coordinates of the selected indicia. In view of the discussion of FIG. 3C, no further discussion of FIG. 3D or its operation is believed necessary.

Figure 4:
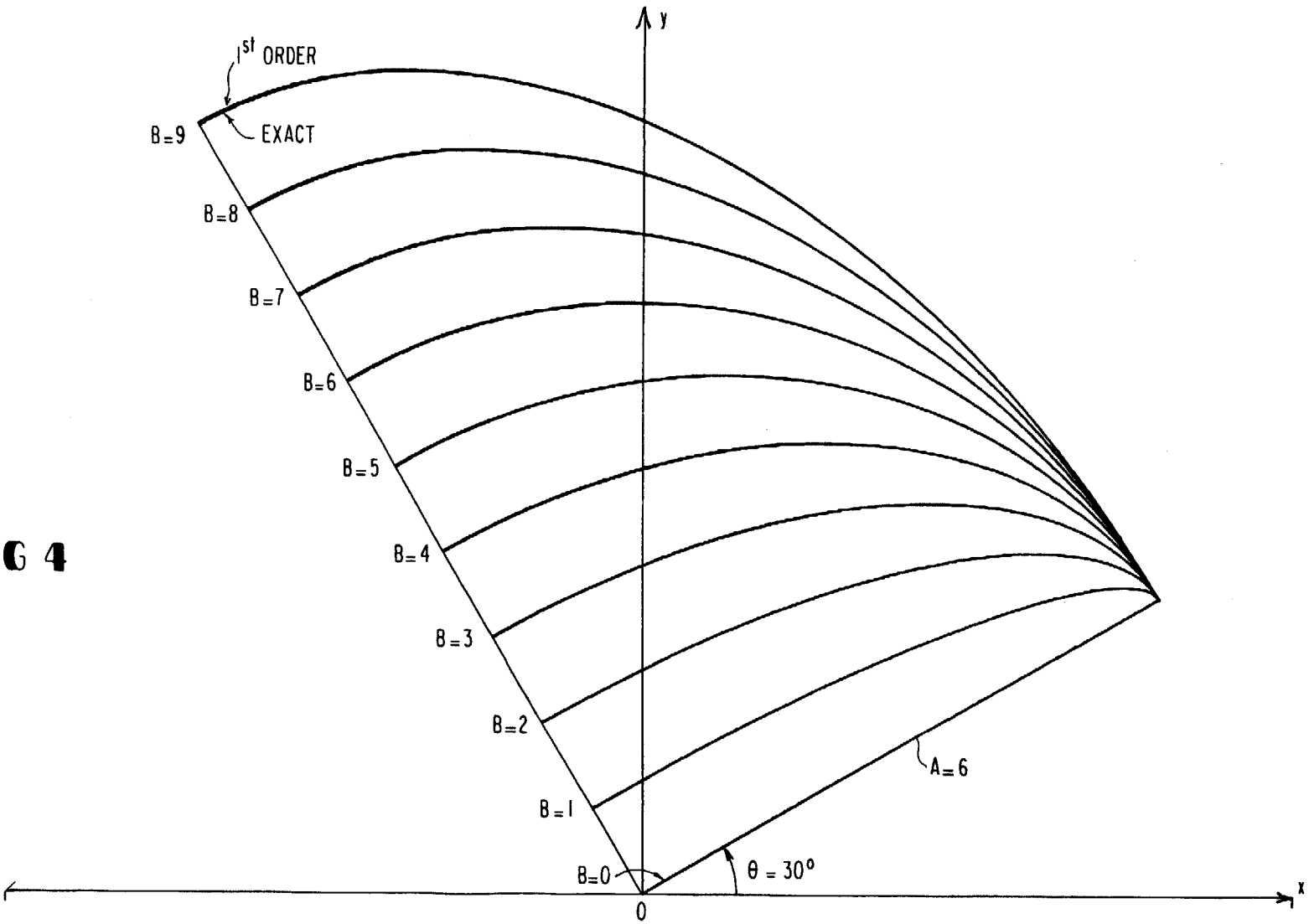
FIGS. 4 and 5 are simulations of the operation of the processor of FIGS. 3D and 3C, respectively.
Figure 5:
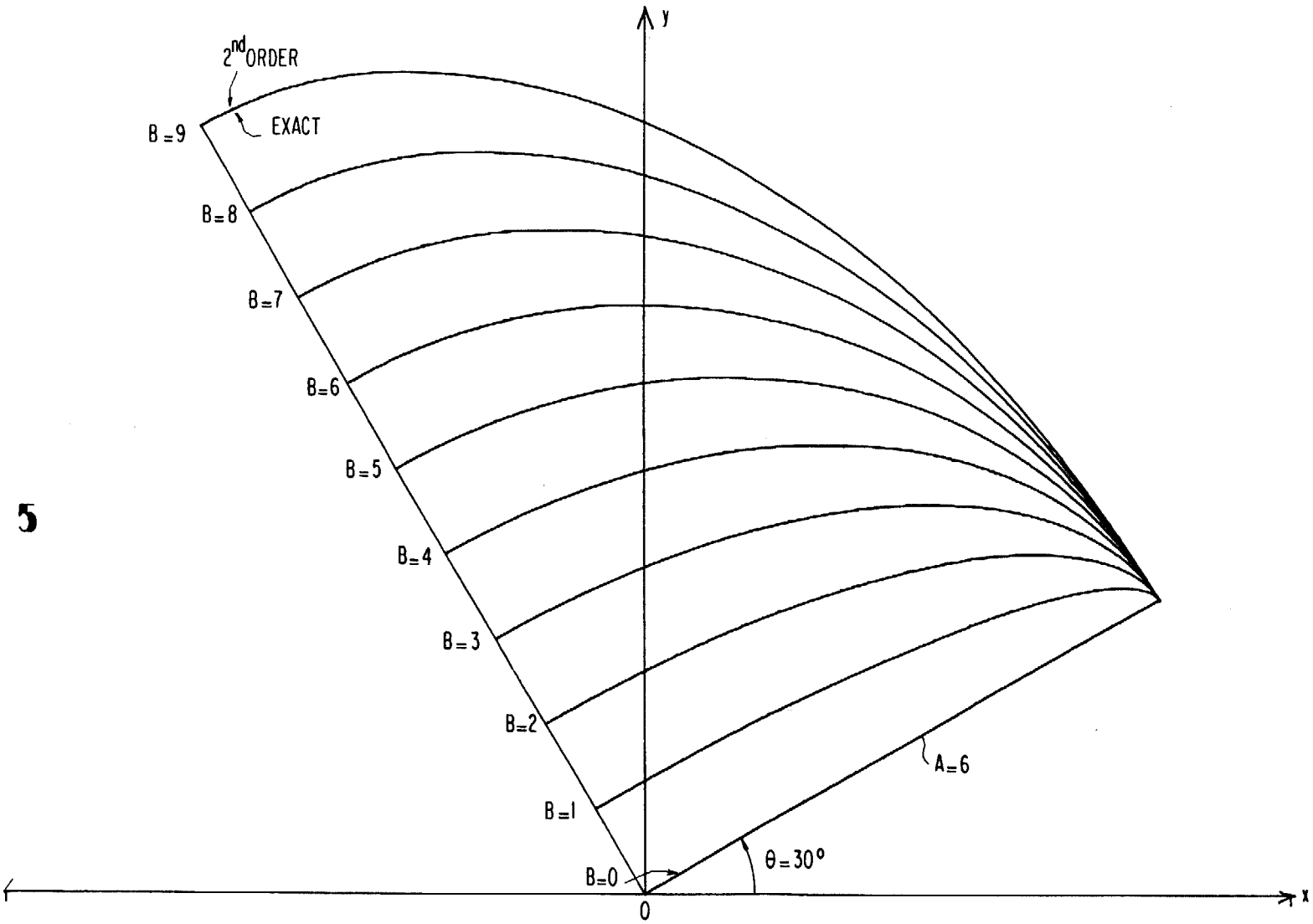

FIGS. 4 and 5 show, respectively, a simulation illustrating the output of the inventive processor for the first order recursive processor of FIG. 3D, and the second order recursive processor FIG. 3C. Each of the Figures shows one quadrant of a set of ellipses with one half axis A equal to 6 units, and the other half axis B ranging from 0 to 9, in steps of one unit. As shown, each of the ellipses is rotated 30° (hence $\theta=30°$) with respect to the coordinate system. Each of FIGS. 4 and 5 illustrate an exact ellipse for comparison with the simulated results from the inventive processor. Note that in FIG. 4 the difference between the exact ellipse and the result of the inventive processor is less than one line width, and that in FIG. 5, no difference can be ascertained. FIGS. 4 and 5 also illustrate that the circle and straight line are degenerate forms of ellipses; in particular, for the case B=0, the ellipse is degenerated into the straight line illustrated, and for B=A=6, the curve produced is a quadrant of a circle.

While the foregoing has considered the problem of generating a display in a Cartesian coordinate system, the inventive processor is by no means limited to such a particular sweep pattern. A popular alternative to the use of a raster sweep is the polar sweep and, as will now be described, the inventive processor can also be employed with display systems operating in a polar sweep.

Preferatory to describing the manner in which the inventive processor is so used, reference is again made to the referenced patent for an illustration of the manner in which the signals, representing coordinates of points on the indicia sought to be displayed, can be employed to actually cause the various points to be illuminated. That patent discloses that the computed values of the various coordinates are stored in scratch pad memories and read out in coordination with the sweep. Similar apparatus is employed with the inventive processor of the present invention as will be made clear hereinafter.

Figure 6:
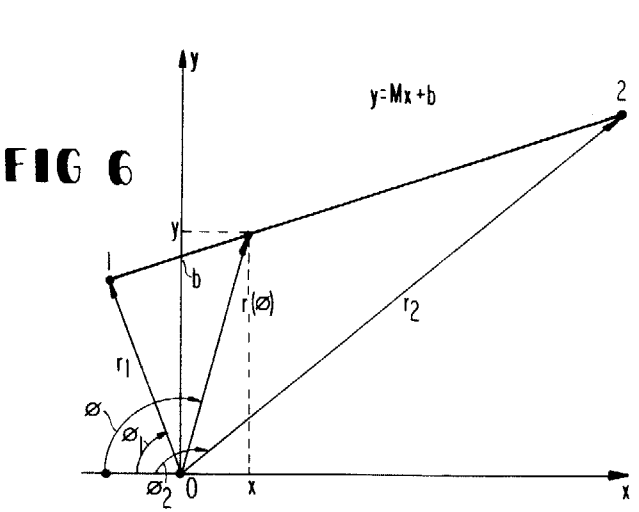
FIG. 6 is a representation of a straight line in a Cartesian and polar coordinates.

FIG. 6 illustrates a typical straight lines whose equation, in Cartesian coordinates, is $y=Mx+b$, as is shown in FIG. 6. In polar coordinates, the same equation can be written as $$r=b/(\sin\phi-M\cos\phi) \tag{21}$$

In equation 21, the parameters b and M have the same meaning as they do in the Cartesian expression, r represents the radial length of a vector from the origin to any point on the indicia, and $\phi$ represents the corresponding angle to the associated point.

The form of Eq. 21, makes it difficult to use $r(\phi)$ and derivative $r'(\phi)$ to recursively generate $r(\phi)$ data, as exemplified in the quoted patent. However, this difficulty is removed by using not $r(\phi)$ but its reciprocal $s(\phi)=1/r(\phi)$. Thus, the inventive processor uses $$s(\phi)=1/r(\phi)=(1/b)\sin\phi-(M/b)\cos\phi. \tag{22}$$

In the referenced patent, the straight line of FIG. 6 is approximated in polar coordinates by computing an incremental $\Delta r$ for each fixed incremental $\Delta\phi$ until the resultant curve deviates from the straight line beyond acceptable limits of accuracy of fit. Because the approximating graph $r(\phi)$ is a curved spiral, tangent to the straight line at the mid-span of fit, more than one spiral is required to yield a piece-wise fit to the straight line. The required number of approximating spirals increases in the region where the straight line approaches the origin of coordinates where the spirals have a large curvature. It is also required to store in memory the start/stop parameters and the $\Delta$ r's for approximating spirals, and to have computer logic functions which transfer from one spiral to the next as the azimuth parameter $\phi$ increases. In the inventive processor, the foregoing piece-wise segmentation and its required memory is not needed, and the saw-tooth residuals from the spiral approximation is eliminated, as will be shown later, resulting in an almost complete absence of error.

In this form the $s(\phi)$ vs. $\phi$ equations is of the form of Eq. (5), allowing the same advantageous inventive recursive development for $s(\phi)$ and $s^1(\phi)$.

FIG. 6 illustrates two representative points 1, 2 on the indicia, associated with the radial vectors $r_1$ and $r_2$; the vectors are associated, respectively, with azimuth $\phi_1$ and $\phi_2$. In order to relate adjacent other points r on the indicia, we note that $$\frac{1}{b}=\frac{r_2\cos\phi_2-r_1\cos\phi_1}{r_1r_2\sin(\phi_1-\phi_2)}=C \tag{23}$$

and

-continued $$\frac{M}{b} = \frac{r_2\sin\phi_2 - r_1\sin\phi_1}{r_1r_2\sin(\phi_1 - \phi_2)} = D \tag{24}$$

and so, as in Eq. 5 and 6 and Eq. 13 and 14

$$s(\phi) = C\sin\phi - D\cos\phi \tag{25}$$
$$s^1(\phi) = C\cos\phi + D\sin\phi \tag{26}$$
$$s(\phi + u) = S(\phi)\cos u + s^1(u)\sin u \tag{27}$$
$$s^1(\phi + u) = s^1(\phi)\cos u - s(\phi)\sin u \tag{28}$$

Again, Eq. 27 and 28 are exact and hold for all values of u. For small values of u, using the second order approximation $\cos u = 1-(u^2/2)$ and $\sin u = u$, equation 27 and 28 become, approximately $$s(\phi + u) = s(\phi) - \frac{u^2}{2}s(\phi) + us'(\phi) \tag{29}$$

$$s'(\phi + u) = s'(\phi) - \frac{u^2}{2}s'(\phi) - us(\phi) \tag{30}$$

Figure 7:
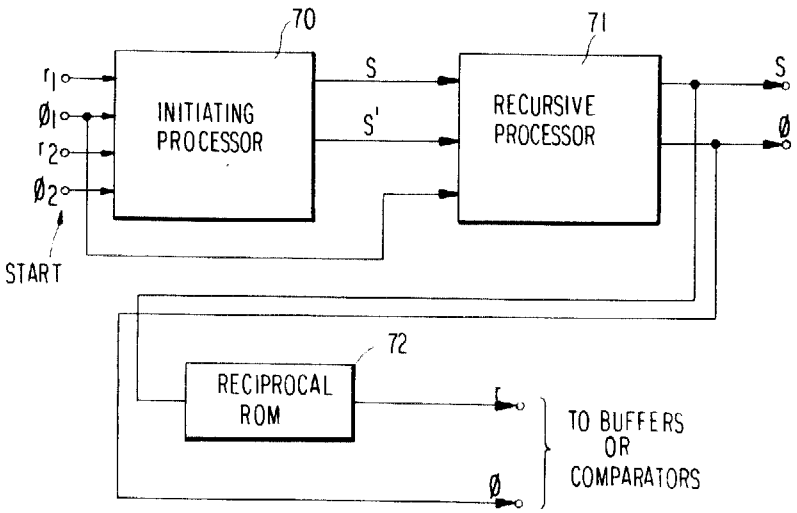
FIG. 7 is a block diagram of a processor useful for sweeps in polar form.
Figure 8:
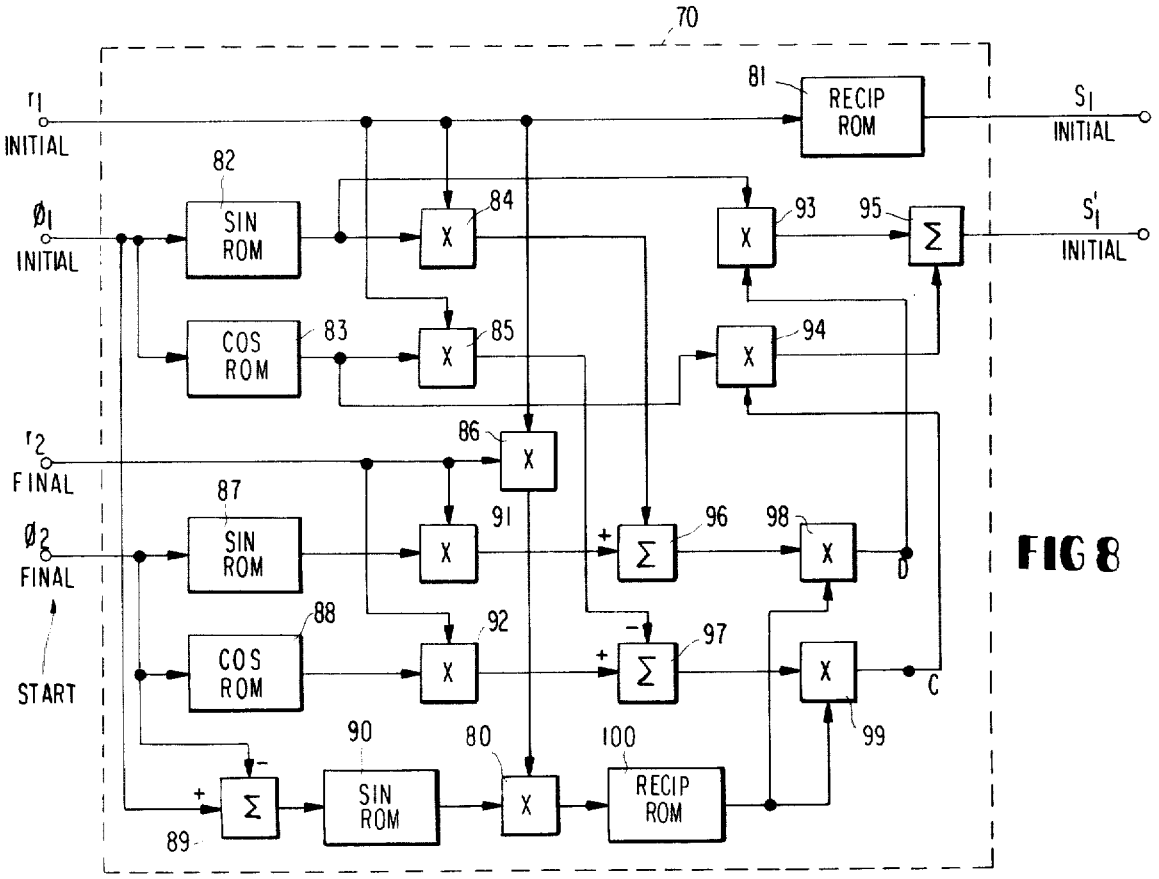
FIGS. 8 and 9 are detailed block diagrams of components of FIG. 7.
Figure 9:
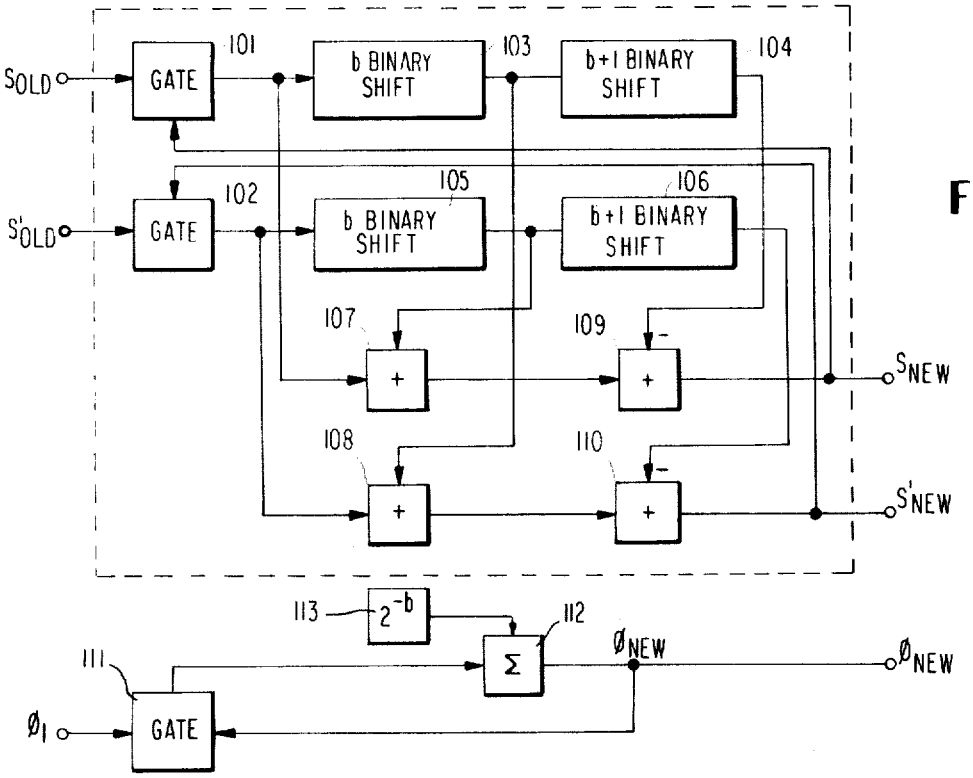

FIGS. 7, 8 and 9 illustrate, respectively, block diagrams of another embodiment of the inventive processor for generating signals necessary for display of straight line indicia in a polar coordinate system, a detailed block diagram of the initiating processor of FIG. 7 and a detailed block diagram of the recursive processor of FIG. 7.

In more detail, as shown in FIG. 7, the inventive processor includes an initiating processor 70 and a recursive processor 71. Inputs to the initiating processor comprise a pair of coordinates, each coordinate represented by a radius parameter and an azimuth or angular parameter which inputs are effective when gated by the start signal. The output of the initiating processor 70 comprises a single reciprocal radius parameter s, and a corresponding rate of change s', which are provided as inputs to the recursive processor 71. An additional input to the recursive processor 71 is the initial angular parameter $\phi_1$. Outputs of the recursive processor include a sequence of digital signals each representing a different coordinate on the indicia to be displayed, each coordinate comprising an s and an angular parameter $\phi$. Desirably, the reciprocal radius parameter s is coupled through a reciprocal ROM 72 to output a corresponding radius parameter r. A sequence of such corresponding coordinates r, $\phi$, when coupled to a display system, for example, as illustrated in the referenced patent, will result in the production of the display of the desired indicia.

The initiating processor 70 is illustrated in FIG. 8. The initiating processor of FIG. 8 implements equations 23–24. More particularly, the parameter $r_1$ is coupled as an input to a reciprocal ROM 81 as well as to one input of multipliers 84,85 and 86. Reciprocal ROM 81 correlates an input used as an address with the reciprocal quantity. Thus, input $r_1$ results in output $s_1$ where $s_1 = 1/r_1$. In a similar fashion, the $r_2$ parameter is coupled as an input to multipliers 91, 92 and 86. The initial azimuth parameter $\phi_1$ is coupled as an input to sin ROM 82, cos ROM 83, and to a non-inverting input of summer 89. The other azimuth parameter $\phi_2$ is coupled as an input to sin ROM 87, cos ROM 88 and to the inverting input of adder 89. The output of the sin ROM 82 is coupled as the other input to the multiplier 84, and also as and input to a multiplier 93. The output of the cos ROM 83 is coupled as the other input to multiplier 85, and as an input to a multiplier 94. Similarly, the output of sin ROM 87 is coupled as the other input to multiplier 91. The output of cos ROM 88 is coupled as the other input to multiplier 92. The output of the adder 89 is coupled as an input to the sin ROM 90. The output of multipliers 91 and 84 are summed in a summer 96, the output of which is coupled as one input to multiplier 98. The output of the sin ROM 90 is coupled as one input to a multiplier 80, the other input of which is provided by the multiplier 86. The output of the multiplier 80 is coupled as the input of the reciprocal ROM 100, the output of which is provided as the other input to multiplier 98 and one input to multiplier 99. The output of the multiplier 92 is coupled to a non-inverting input of summer 97. The inverting input of summer 97 is provided by the output of multiplier 85, and the output of the summer 97 is the other input to the multiplier 99.

While FIG. 8 represents the second coordinates $r_2$ and $\phi_2$ as "final", those skilled in the art will appreciate that choice is convenient but arbitrary, and any other intermediate coordinate can be selected. As was the case with the initiating processor of FIG. 3B, on application of the input parameters a single cycle of operation of the initiating processor produces the desired results, that is, more particularly, $s_1$ and $s'_1$. With these parameters, the recursive processor will produce a sequence of digital signals, each representing in polar coordinate form, a plurality of points on the indicia desired to be displayed.

The recursive processor of FIG. 9 includes components identical to the recursive processor of FIG. 3C, and operates in a similar fashion to produce, from inputs labelled $s_{old}$ and $s'_{old}$ (derived from the initiating processor of FIG. 8) a sequence of quantities $s_{new}$ and $s'_{new}$, the former of which form one of the parameters for coordinates of the indicia to be displayed.

The processor disclosed in connection with FIG. 3 implemented an equation in which the augmenting parameter u was a dummy variable, and as a result, a recursive processor or processing function was required for both the parameters which made up the coordinate. In contrast, the augmenting parameter of equations 29 and 30 is the angular coordinate itself. As a result, a recursive processor or processing function is not required to generate, from an old value of $\phi$ a new value of $\phi$. Rather, the old value, i.e., $\phi_1$, is coupled to a gate 111 (similar to gate 101 and 102). The output of gate 111 is provided to a summer 112, the other input to which is provided by a device 113 providing an ouput signal representing u. The result, i.e., the output of summer 112, is $\phi_{new}$, that is $\phi_{new} = \phi_{old} + u$ (when $\phi_{old}$, $\phi_{new}$ and u are expressed in radian measure). Accordingly, to generate a sequence of $\phi_{new}$, it is only necessary to feed back the prior $\phi_{new}$ as the other input to gate 111. Thus, on the first operation of the initiating processor, the value $\phi_1$ is coupled through gate 111 to the summer 112. Subsequently, however, the gate 111 passes the output of summer 112 back to its input to thereby produce a sequence of $\phi_{new}$ values, each corresponding to an $s_{new}$ value. Of course, the cycling of the recursive processor of FIG. 9 requires that the $s_{new}$ values and $\phi_{new}$ values be produced in synchronism so that corresponding $s_{new}$ and $\phi_{new}$ values can be correlated. However, as mentioned above, the clocking and control circuits required to effect the synchronization is readily apparent to those skilled in the art and is not detailed herein.

Figure 10:
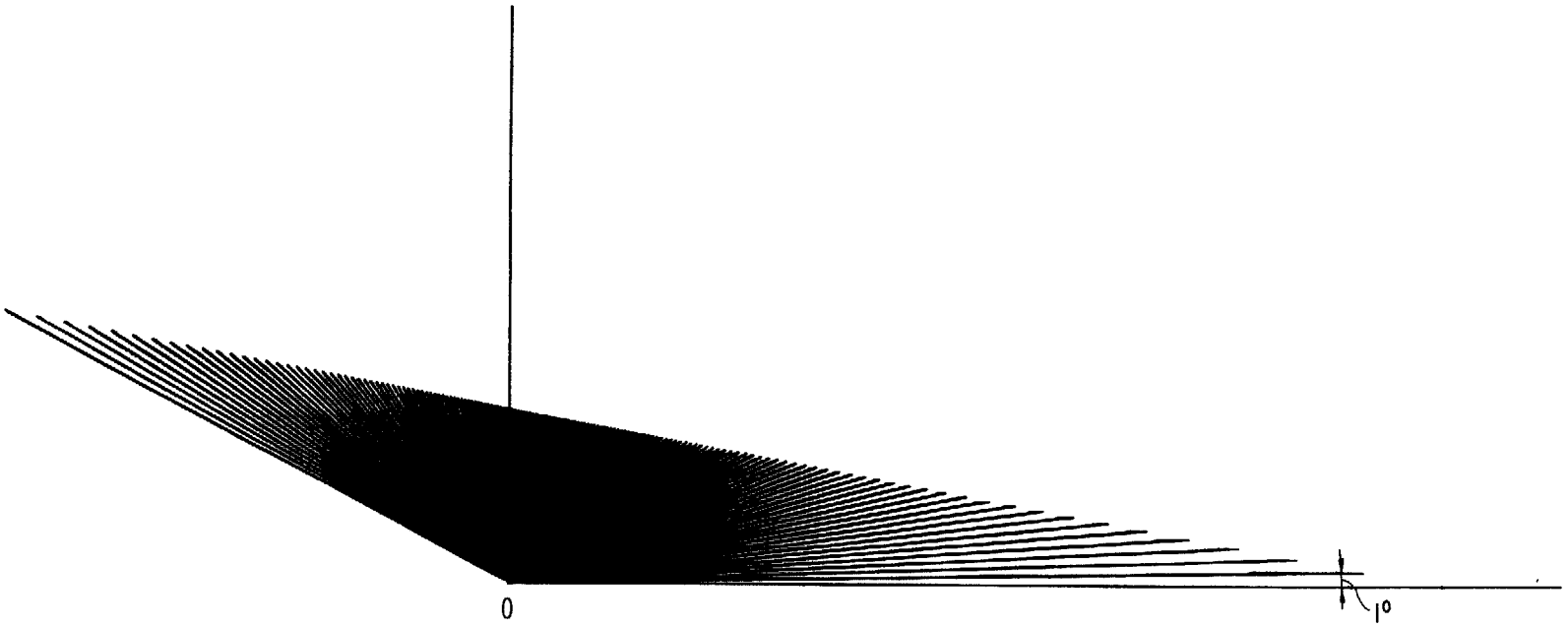
FIG. 10 is a simulated output of the processor of FIG. 7.

FIG. 10 is a simulation of the operation of the processor of FIG. 7 arranged to draw a straight line. To illustrate the results of the processing operation, FIG. 10 illustrates each line (vector), from the origin to the desired indicia. Of course, on an actual display, the entire line is not displayed and only the end point is actually illuminated. The reader can verify the accuracy with which the simulated processor has functioned by noting that the end points lie quite accurately on a straight line.

Figure 11A:
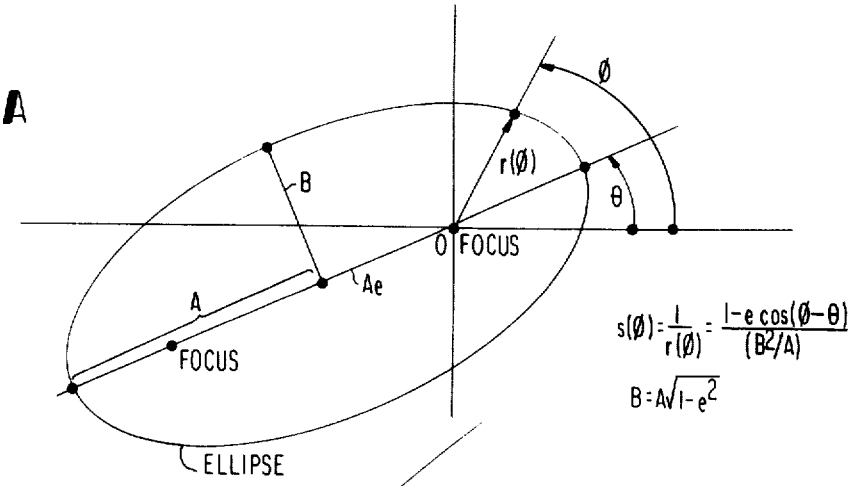
FIG. 11A is a representation of an ellipse in polar form with either focus at the origin.
Figure 11B:
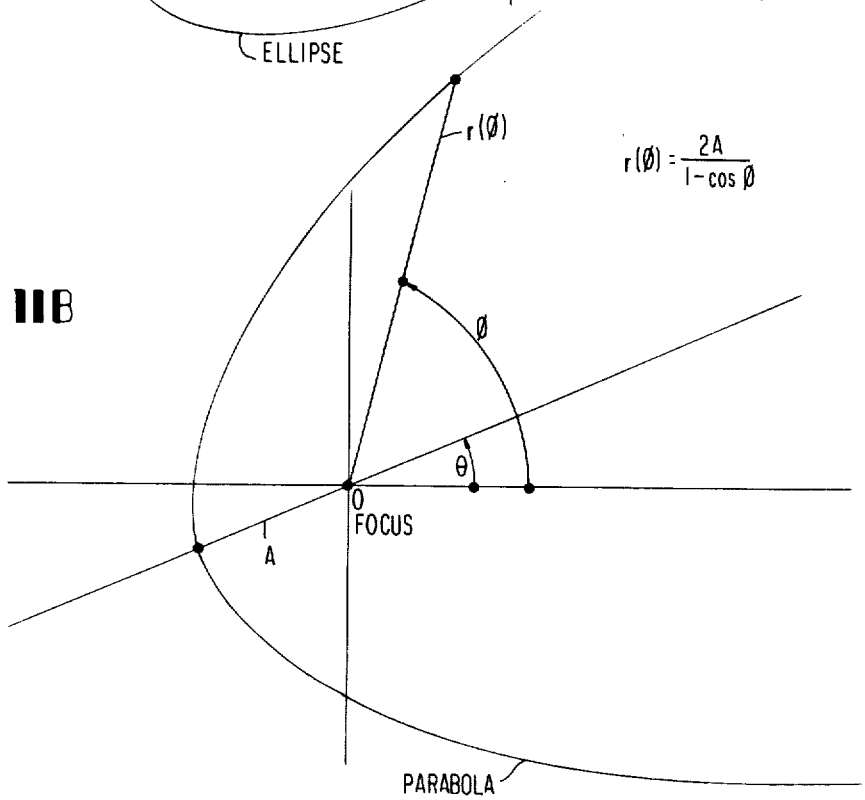
FIG. 11B is a representation of a parabola in polar form with its focus at the origin.

Although the present description is that of a processor for displaying straight lines in polar coordinates, those of ordinary skill in the art will realize how the same techniques can be employed to display any other r,$\phi$ curves which have the same generic form as FIG. 2. Examples of such other curves are ellipses with one focus at the origin, and parabolas with its focus at the origin, such as shown in FIG. 11*a* and 11*b*, respectively. To effect this, only the initiating processor need be altered.

Figure 12A:
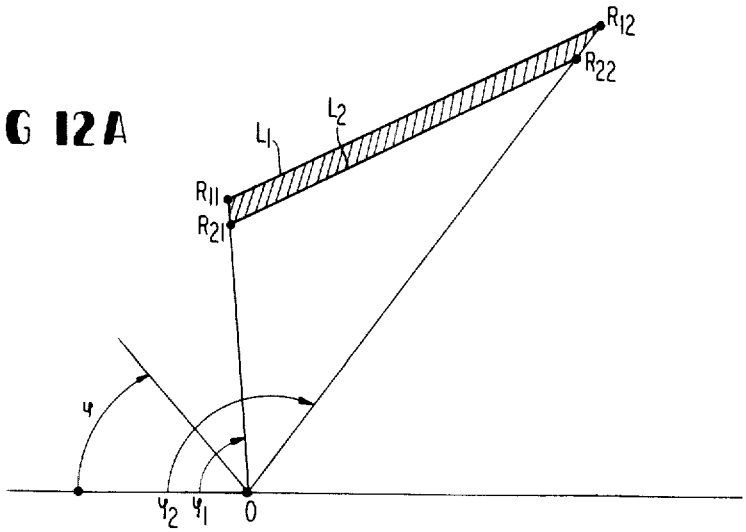
FIG. 12A illustrates the use of the processor in a radar displaying only those targets on a straight line airport landing strip.
Figure 12B:
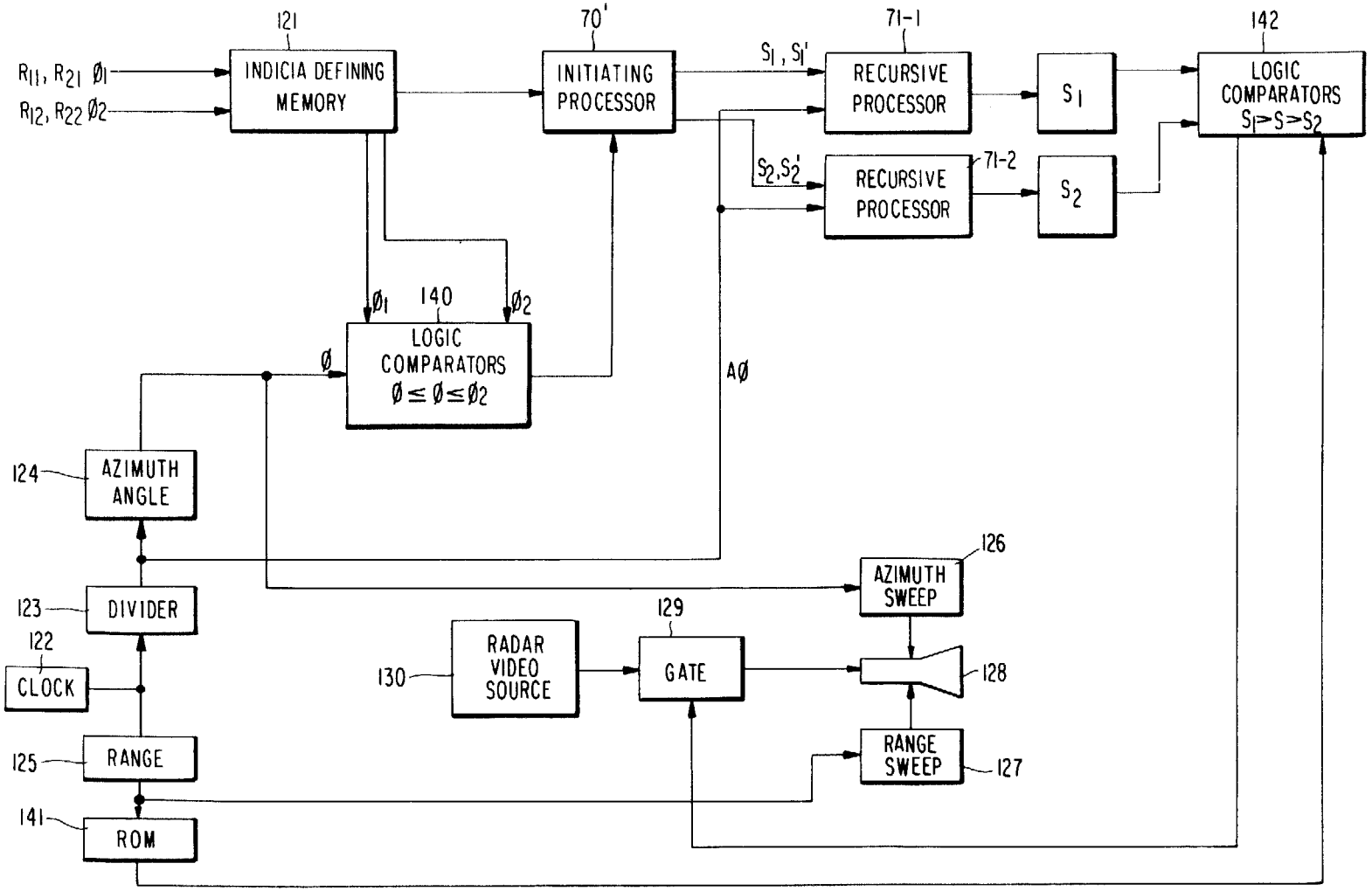
FIG. 12B is an embodiment of the inventive processor to effect the display of FIG. 12A.

The foregoing description has been that of a display generator which, in response to indicia defining signals allow coordinates of the indicia to be generated more rapidly than in the prior art, and which may be rapid enough to eliminate the necessity for actually storing information respecting each coordinate to be displayed. However, the invention can be applied in a display generator in which the indicia, whose coordinates are determined by the inventive processor are not themselves displayed, but in which those coordinates are employed to select information bearing signals that ought to be displayed, from among a larger set of information bearing signals. Thus, for example, FIGS. 12A and 12B are useful in explaining another embodiment of the invention, which is used to display only those signals representing radar targets which are within a predetermined boundary, i.e., a particular runway of an airport. FIG. 12A represents a PPI of a radar in which it is desired to display only those targets within the shaded region lying between the parallel lines L1 and L2, which lines are defined from a start azimuth $\phi_1$ to a stop azimuth $\phi_2$, the line L1 being associated with radial end points R11 and R12 and line L2 being associated with radial end points R21 and R22. These parameters, i.e., the start and stop azimuths $\phi_1$ and $\phi_2$ and the radial end points are sufficient to define each of the indicia (all boundaries) L1 and L2.

FIG. 12B is a block diagram of this embodiment of the invention. As shown in FIG. 12B, a memory device 121 is arranged to store the information representing the indicia or boundary defining information referred to immediately above. When loaded, the indicia defining memory 121 makes these indicia available to an initiating processor 70' (which can comprise duplicate processors 70 illustrated in FIG. 8), so that the initiating processor 70' makes available, as output signals, information representing $s_1$ and $s'_1$, and likewise with respect to line L2 makes available the signals $s_2$ and $s'_2$. Before further describing the use of these signals, reference is made to the portions of FIG. 12B which illustrate conventional components for PPI display. More particularly, a clock 122 provides timing signals at a constant repetition rate to a divider 123 and a range counter 124. The divider 123 provides timing signals, synchronized with the output of clock 122 but at a lower rate, to an azimuth angle counter 124. At any point in time the output of the azimuth angle counter 124 is a representation of the present azimuth angle $\phi$ of the sweep. The outputs of the azimuth angle counter 124 and the range counter 125 are coupled to sweep circuits 126 and 127 respectively for generating deflection voltages for deflecting an electron beam of CRT 128, so as the voltages change the beam sweeps across the face of the CRT 128 in a polar swept format. A radar video source 130 represents any source of radar video signals representing targets which generate return radar signals, and this source of information signals is coupled to a gate 129. The output of the gate 129 is coupled to the control electrode of the CRT 128 such that, those information bearing signals provided by the source 130, which pass the gate 129, are displayed. The manner in which the control signals for the gate 129 are developed will now be discussed.

Comparators 140 are subjected to three inputs and provide an output; the comparators 140 are subjected to an input corresponding to the present azimuth angle $\phi$, as well as to the start and stop azimuths $\phi_1$ and $\phi_2$. The output of comparators 140 may be used to gate the outputs of initiating processor to the recursive processor from buffers which store the output of initiating processor. Alternatively, the output of comparators 140 may be used to gate the initiating processor 70' into operation. In either event the signals $s_1$, $s'_1$, $s_2$ and $s'_2$ are fed respectively to recursive processors 71-1 and 71-2. These recursive processors can take the form of that shown in FIG. 9. The outputs of each of the recursive processors, are respectively $s_1$ and $s_2$. These quantities, of course, comprise a reciprocal radius corresponding to one of the two terminal points of each line. The range count output, from range counter 125 is also applied to a reciprocal ROM 141. Accordingly, the output of ROM 141 corresponds to a reciprocal of the range, at which the sweep is developed, in real time. This is applied to an input of comparators 142, the other inputs of which comprise the output of the recursive processors 71-1 and 71-2. When, and only when, the range sweep lies between the limits imposed by $s_1$ and $s_2$, the comparators 142 produce an enabling signal to the gate 129. Accordingly, any radar video signals at the start azimuth ($\phi_1$) and lying within the lines $L_1$ and $L_2$, will be passed by the gate 129 and displayed.

As the azimuth is indexed, the azimuth counter, 124 changes state and accordingly the azimuth sweep 126 produces an altered deflection voltage to effect display of this azimuth. At the same time, the pulse producing the change in the azimuth angle counter state is coupled to the recursive processors 71-1 and 71-2 to initiate an operation of these processors to determine new quantities $s_1$ and $s_2$ corresponding to the new azimuth. A signal coupled from the divider 123 to the recursive processors 71-1 and 71-2 can be provided to the gating circuits 101 and 102 (see FIG. 9) to allow the representation of $s_{new}$ to be coupled to the recursive processor. Thus, in this range sweep new quantities $s_1$ and $s_2$ are employed by the comparators 142. In this fashion, for each azimuth which is displayed, the appropriate radial boundary points are determined and the gate 129 is enabled for only those radar video signals lying between the boundaries.

It should be noted that coordinates of the boundaries are determined "on the fly", are not stored anywhere, and are, in fact, computed as the display is being generated. Furthermore, these coordinates are not themselves displayed but only form the boundaries in order to select that radar information which is to be displayed.

It should be apparent that the memory 121, initiating processors 70', recursive processors 71-1 and 71-2 along with the comparators 142 can be duplicated a number of times for each different boundary condition, and thus plural boundaries can be active at any one time. It should also be apparent that the apparatus of FIG. 12B does not require the coordinates of the boundaries to be precomputed and stored, thus simplifying this equipment.

The preceding discussion has assumed that the azimuth change signal, representing azimuth change $\Delta\phi$ is equal to u, the incrementing variable of the recursive processor. This need not be required if $n\,\Delta\phi = u$, where n is an integer greater than one, a counter can be used to divide the azimuth change pulses which are used to stimulate the recursive processor. If $\Delta\phi = nu$, where n is an integer greater than one, a clock and preset counter can be used to stimulate the recursive processor n times for each azimuth change pulse, where the counter is preset to n, and the clock is used to count the counter down, each time the counter changes state the recursive processor is stimulated.

While the present description is of a discrete logic circuit embodiment of the invention, those skilled in the art will realize that the logic operations performed by the discrete circuits illustrated in the drawings of this application can be performed instead by a stored program processor, by properly programming the same. Therefore, the claims appended hereto should not be limited to the forms of the invention specifically disclosed herein.

What is claimed is:

1. In a display device for displaying selected indicia on a field swept in a predetermined pattern apparatus for determining coordinates of an ellipse or degenerate forms thereof including:

a processor for generating a sequence of digital signals, each representing a coordinate of said selected indicia in response to indicia selection signals, said processor comprising:

initiating processor means responsive to said indicia selection signals for producing at least one signal representing a first coordinate and a further signal representing a rate of change of at least one component of said first coordinate, recursive processor means consisting essentially only of adders and shifters with an output of said recursive processor means coupled to an input and responsive to said at least one signal and to said further signal for producing a sequence of digital signals, each representing different coordinates of said selected indicia, each said different coordinates spaced from adjacent coordinates by a predetermined distance, and comparator means responsive to said signal sequences from said recursive processor means, and to signals indicative of instantaneous sweep position for illuminating said display field when said sweep is in a position corresponding to a coordinate of said indicia.

2. The apparatus of claim 1 in which said recursive processor means generates for each digital signal in said sequence representing a coordinate, a further digital signal representing rate of change of at least one component of said coordinate.

3. The apparatus of claim 2 wherein said recursive processor means includes at least one recursive processor, each said recursive processor including:

a pair of shifting means, each with input and output, each for shifting digital signals provided at said input and producing shifted signals at said output, a pair of algebraic summing means, each with inputs and an output, for summing digital signals at said inputs to produce a summed signal at said output, and gating means for at times coupling said initiating processor means to said shifting means and for, at other times, coupling outputs of said pair of algebraic summing means to said shifting means.

4. The apparatus of claim 3 wherein:

said pair of shifting means includes a first and second shifting means, each shifting an input by a predetermined and equal amount, said gating means comprises first and second gates, each with an output coupled respectively to first and second shifting means and wherein, said pair of algebraic summing means includes first and second adders with inputs of said first adder coupled to said first gate and said second shifting means and with inputs of said second adder coupled to said second gate and to said first shifting means, outputs of said first adder comprising said signal sequence, and wherein outputs of said first and second adders are connected to other inputs of said first and second gates, respectively.

5. The apparatus of claim 3 wherein said pair of shifting means includes:

first and second shifting means, each including a prime shifting means and associated auxiliary shifting means, with an output of said prime shifting means connected to an input of an associated auxiliary shifting means, said gating means comprises first and second gates, each with an output coupled respectively to inputs of said prime shifting means, said pair of algebraic adders comprising first and second prime and auxiliary adders, each with two inputs and an output, inputs of said first prime adder connected to said first gating means and to said second prime shifting means, inputs of said first auxiliary adder connected to an output of said first prime adder, and to said first auxiliary shifting means, inputs of said second prime adder connected to said second gate and an output of said first prime shifting means, and said second auxiliary adder connected to said second prime adder and to said second auxiliary shifter means, outputs of said first auxiliary adder comprising said signal sequence, and wherein outputs of said first and second auxiliary adders are connected respectively to inputs of said first and second gates.

6. A display apparatus for displaying information bearing signals having a predetermined relationship with fixed indicia comprising means for generating signals indicative of said indicia, processor means responsive to said indicia indicating signals for producing in response to a gating signal a sequence of digital signals each representing different coordinates of said fixed indicia, a clock, two dimensional sweep means responsive to said clock for generating sweep signals for sweeping a display field in two dimensions, first gating means for gating said information bearing signals, visible signal generating means responsive to said sweep means and to said first gating means for generating visible signals corresponding to information bearing signals passed by said first gating means, first comparator means for comparing one of said indicia defining signals with a signal representing one coordinate of said instantaneous sweep position and for generating an output signal, second gating means responsive to said first comparator means for producing said gating signal for gating said processor means in response to an output signal from said first comparator means representing equal comparison, second comparator means responsive to an output of said processor means and to a signal representative of instantaneous sweep position in another coordinate for producing an output signal when said instantaneous sweep position signal bears a predetermined relation to an output of said processor means, means coupling said output signal of said second comparator means to said first gating means, wherein said processor means includes:

initiating processor means responsive to said indicia indicating signals for producing intermediate signals, and recursive processor means responsive to said intermediate signals for generating said sequence of digital signals, whereby said processor means develops a sequence of digital signals describing said fixed indicia, and said second comparator means is conditioned to control said first gating means to pass only those information bearing signals which are represented by visible signals lying on a selected side of said fixed indicia.

7. The apparatus of claim 6 in which said means for generating signals indicative of said indicia comprises storage means for storing signals indicative of an azimuth range for each said indicia and a radial length for end points of each said indicia at end points of said azimuth range, and in which said processor means includes, said initiating processor means for generating, in response to signals from storage means, said intermediate signals representing radius reciprocal and rate of change of radius reciprocal for at least one point on each said indicia.

8. The apparatus of claim 7 wherein said fixed indicia comprises first and second lines and said recursive storage means stores signals representing start and stop azimuths for said lines and radial length for said lines at said start and stop azimuth, said processor means further comprises first and second recursive processors responsive respectively to signals definitive of said first and second lines for producing first and second sequences of signals, each sequence representing coordinates on said first and second lines respectively, and in which said second comparator means produced said output signal if, and only if, said instantaneous sweep signal represents a coordinate lying between coordinates of said indicia represented by outputs of said first and second recursive processors.

9. The apparatus of claim 8 in which said sweep means produces an azimuth change signal and wherein said apparatus includes means coupling said azimuth change signal to said recursive processor means to control the rate at which said sequences of digital signals is produced.

10. The apparatus of claim 9 in which each said recursive processor means includes shifting means, for shifting a digital signal applied at an input, processor gating means for coupling either an output of said initiating processor means or an output of the recursive processor means to said shifting means input, and summing means responsive to outputs of said gating means and said shifting means and furnishing said output of said recursive processor means.

11. The apparatus of claim 9 wherein said processor gating means, shifting means and summing means each include a first processor gating means, first shifting means and first summing means for processing radius reciprocal representing signals and a second processor gating means, second shifting means and second summing means for processing rate of change radius reciprocal representing signals.

* * * * *